United States Patent [19]

Starchevich

[11] Patent Number: 5,001,455

[45] Date of Patent: Mar. 19, 1991

[54] PORTABLE SIGNALING DEVICE

[75] Inventor: Jovanka Starchevich, New Milford, Conn.

[73] Assignee: Maniolos/Starchevic, New York, N.Y.

[21] Appl. No.: 327,737

[22] Filed: Mar. 23, 1989

[51] Int. Cl.[5] ..... G08B 5/00

[52] U.S. Cl. ..... 340/332; 340/321; 40/555; 40/586; 200/61.7; 200/61.58 R

[58] Field of Search ..... 340/332, 321; 200/60, 200/61.7, 61.71, 61.58 R; 362/186, 196, 205, 812; 40/549, 558, 571, 574, 586, 553, 555

[56] References Cited

U.S. PATENT DOCUMENTS

| | | | |
|---|---|---|---|
| 3,176,092 | 3/1965 | Lukasek | 200/60 |
| 3,252,235 | 5/1966 | Goessling et al. | 40/555 |
| 3,461,448 | 8/1969 | Kramer | 340/321 |
| 4,364,104 | 12/1982 | Holahan et al. | 362/205 |
| 4,432,043 | 2/1984 | Yuen | 200/60 |
| 4,459,646 | 7/1984 | Drawe | 200/60 |
| 4,609,976 | 9/1986 | Geissler | 362/196 |

*Primary Examiner*—Joseph A. Orsino

*Assistant Examiner*—Geoff Sutcliffe

*Attorney, Agent, or Firm*—J. B. Schafrann

[57] ABSTRACT

A portable water-resistant device for signaling vehicles such as a taxi is formed of a lightweight, transparent plastic and is battery powered. The signaling device is provided with a first housing, a second housing movable relative to the first housing, the first housing containing a light source and a power source and reflective symbols affixed to the outer face of the first housing. The light source is selectively electrically connectable to a power source, such as a battery, which is activated when the second housing moves relative to the first housing and contact points extending from battery terminals and protruding through the first housing meet with contact points of the second housing. Additionally, in another embodiment the signaling device may be provided with an outer movable housing having a switch, an inner housing containing a light source and a power source electrically connected to the switch, and reflective symbols on the outer face of the inner housing. Rotation of the outer housing relative to the inner housing closes the switch, thereby supplying electrical energy to the light source.

6 Claims, 3 Drawing Sheets

2
8
4
TAXI
16
10
12
6
14
4
4

3
16
18
14
3

2
28
16
10
6
18
8
8
TAXI
22
12
20
26
14
24

28
30
16
18
8
22
12
2
20
24
14
26

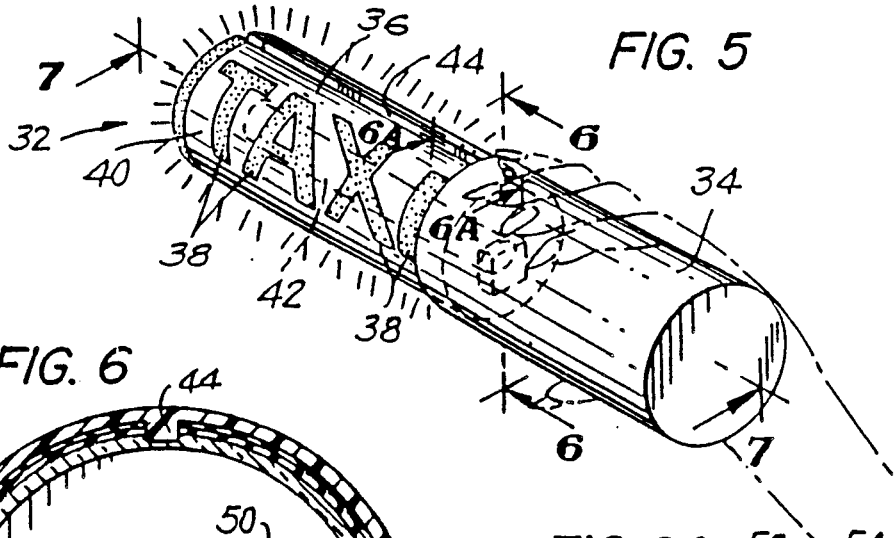
FIG. 5
FIG. 6
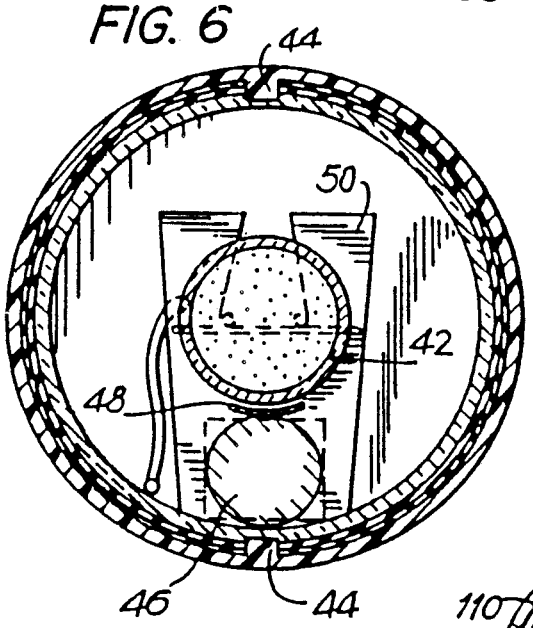
FIG. 6A
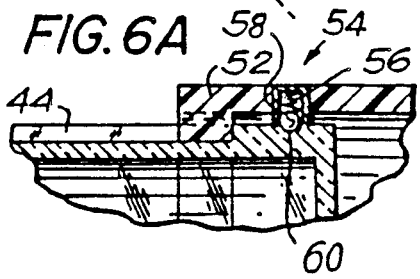
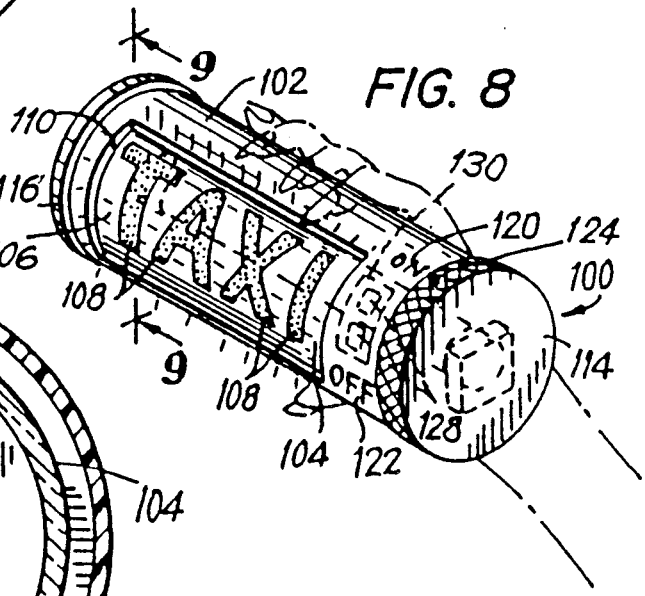
FIG. 8
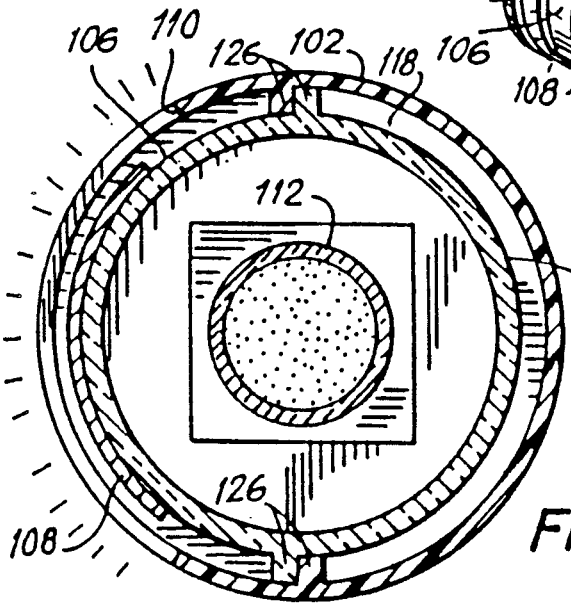
FIG. 9

PORTABLE SIGNALING DEVICE

BACKGROUND OF THE INVENTION

1. Field of the Invention

The present invention generally relates to an apparatus for signaling, and more particularly, to a portable, water resistant apparatus which can be illuminated and used for signaling a vehicle, such as a taxi.

Attracting a taxicab in any major metropolitan area, especially on a dark and rainy night, is fraught with difficulty. No pedestrian wants to run out into the street to attract a taxicab, but this potentially dangerous movement is often necessary because the pedestrian cannot be seen by the moving taxicab from the safety of the sidewalk. Therefore, there is a need for a method by which a pedestrian may safely and reliably signal a taxicab.

This need is not restricted to a dark and stormy nights but arises during the daylight hours as well, when a pedestrian does not wish to run into traffic to attract a taxicab, but would rather summon a passing vehicle from the sidewalk. Thus, the signaling device must have signaling indicia which are visible during both the daylight and evening hours.

In such a situation there is a need for the signaling device to be highly visible, portable and lightweight so that it may be easily carried in a handbag or a briefcase, and it must also be water resistant, so that it will function in rainy weather.

2. Description of the Prior Art

Presently, the known signaling devices that have partially addressed this problem are hand-held, bulky signs used to direct traffic or to warn motorists, such as those disclosed in U.S. Pat. Nos. 2,799,854, 4,042,919, 4,090,186 and 4,235,033. These devices are typical of the prior art, which teaches hand-held signs which are much too large to be carried in a handbag or briefcase, but are, for example, suitable for use by a crossing-guard or law enforcement officer as a traffic safety device. Some attempts have been made to provide a specific taxi signaling device, as described in U.S. Pat. Nos. 3,461,448 and 4,601,120. However, these disclose, respectively, a cumbersome device for attachment to a pole or an umbrella, and a sign made out of flexible material for affixation directly to the material of an umbrella (use of the sign without the umbrella would be very difficult, as it would require two hands by virtue of the sign's flexible nature).

Therefore, the failure of the prior art to deal adequately with these problems demonstrates the existence of a long-standing need to provide a highly visible, portable, lightweight and water-resistant signaling device which can be easily carried in a handbag or briefcase.

It is, therefore, an object of this invention to provide a signaling device which is highly visible in the light or dark.

It is a further object of this invention to provide a signaling device which is portable.

It is another object of this invention to provide a signaling device which is lightweight.

It is also an object of this invention to provide a signaling device which is water-resistant.

SUMMARY OF THE INVENTION

The foregoing and other objects are achieved by this invention, which provides, in a preferred embodiment, an arrangement which permits the pedestrian-user to attract a taxicab while remaining on or near the safety of the sidewalk. In accordance with the invention, a portable, water-resistant signaling device is formed of lightweight plastic and contains a light source which is battery powered.

In one embodiment, the signaling device comprises an outer rectangular housing made of plastic, preferably transparent, an inner slidable rectangular housing containing a light source, such as a small light bulb, which is electrically connected to one or more batteries, and reflective symbols, such as the letters forming the word T A X I, affixed to the outer face of the inner housing. The outer housing completely surrounds the inner housing when the device is not in use, forming a compact, self-enclosed unit. Contact points from the battery terminals protrude through the edge of the inner housing, which edges are shaped to facilitate sliding of the rectangular inner housing in and out of the outer housing. The outer housing is also provided with contact points on its inner curved edge, and the battery is activated when the inner housing slides from one side of the outer housing (closed position) to the other (exposed position), and the contact points meet. An electrical current is thereby completed from the battery to the light source and the reflective letters are illuminated. The inner housing is prevented from being pulled completely out of the outer housing by ridges built into the outer housing structure. The light source is deactivated when the inner housing slides back into the outer housing, returning the unit to the closed position.

In still another embodiment, the inner and outer housings are circular in shape, with the inner housing slidably mounted and the device formed and activated in the same manner as in the first embodiment.

In a further embodiment, the inner and outer housings are circular in shape, with the outer housing rotatably mounted with respect to the inner housing. The inner housing contains a light source and a power source, such as a battery, with reflective symbols mounted on one curved surface of its outside face. Corresponding contact points are located on the inside surface of the outer housing and the outside surface of the inner housing, connected to a switch on the outer surface of the outer housing. The light source is activated via its battery connection when the outer housing is rotated relative to the inner housing to reveal the reflective symbols as the contact points meet and the switch is closed.

In another embodiment of the invention, rather than relying on an outer housing which surrounds an inner housing, there is a movable panel covering the reflective symbols, which are similarly affixed to the outer face of the inner housing. The inner housing is provided with a track along which the panel may slide. On the side of the movable panel facing the symbols are the electric contacts for completing the circuit to the bulb when the housings are in the open position. The battery activates the lamp when the panel slides from one side to another and the contact points meet. Ridges are built into the panel and the inner housing structure to prevent the panel from being completely withdrawn from the signaling device.

In yet another embodiment of the invention, there are two housings, one on top of the other, connected at one end by a hinge mechanism. Within the first (top) housing are a power source, such as a plurality of batteries, electrically connected to a light source, such as an incandescent bulb or a fluorescent tube. Electrical contacts from the battery terminals protrude through the side panel of this first housing at the hinged end. Reflective symbols are placed on the outer face of this first housing, so that they may be illuminated when the lighting circuit is completed.

The second (bottom) housing also has a set of contact points protruding through the side panel at the hinged end. When the second housing is unhinged, it travels in a 180 degree arc and joins with the first housing at the side panels, such that both housings are adjacent. Thus, the contact points meet, illuminating the reflective symbols. In this side by side position, the second housing also acts as a handle, so that the pedestrian can easily hail a taxi with one hand while holding packages in the other.

In any of the previously described embodiments, the light source may also be a fluorescent tube along a portion of the horizontal length of the signaling device. For instance, a miniature fluorescent tube such as the Parly FL-4D, approximately 5¼ inches in length and one-half inch in diameter, is suitable. The tube is connected to an electronics package which converts direct current (DC) to alternating current (AC). The electronics package contains a power inverter, transformer, oscillator circuit and other appropriate components. The electronics package is connected to a plurality of batteries. The wiring of the fluorescent tube light source embodiment is similar to that found in a combination fluorescent lamp and flashlight assembly of a type well-known in the art. The device is activated in the same manner as previously described. Each embodiment described also contains a removable panel for access to the power source.

BRIEF DESCRIPTION OF THE DRAWINGS

Comprehension of the invention is facilitated by reading the following detailed description in conjunction with the annexed drawings in which:

FIG. 5 is a perspective view of a circular signaling device having an outer housing in an exposed position with respect to an inner housing;

FIG. 6 is an enlarged cross-sectional view of the signaling device taken along line 6—6 of FIG. 5;

FIG. 6A is a cross-sectional planar view of the signaling device of FIG. 5;

FIG. 8 is a perspective view of a circular signaling device having a rotatably mounted outer housing with respect to an inner housing;

FIG. 9 is an enlarged cross-sectional view of the signaling device of FIG. 8 taken along line 9—9 of FIG. 8.

DETAILED DESCRIPTION

Figure 1:
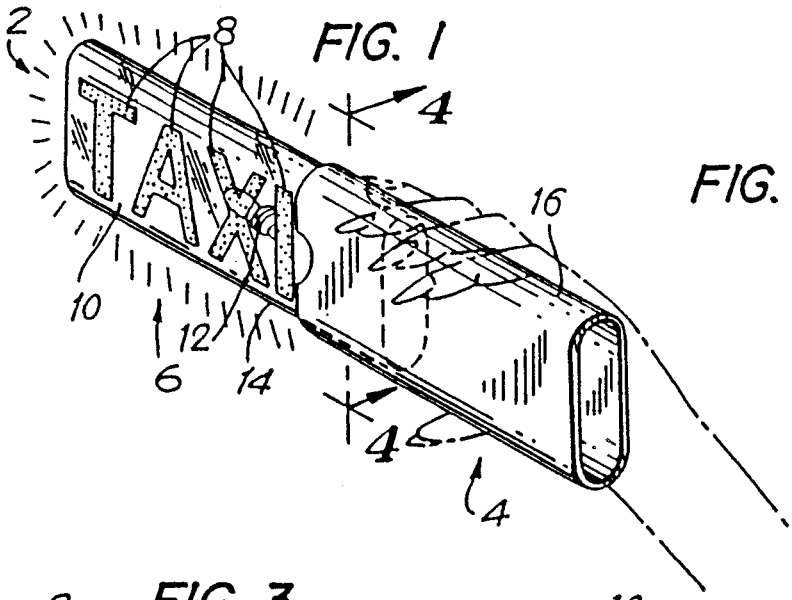
FIG. 1 is a perspective view of a rectangular signaling device having illuminated lettering thereon, constructed in accordance with the principles of the invention.

FIG. 1 is a representation of a signaling device 2 having a generally rectangular outer housing 4 (preferably made of transparent plastic) and a generally rectangular inner housing 6 sized and shaped to slide within outer housing 4. Symbols 8, forming the word "TAXI", are affixed to outer face 10 of inner housing 6. Contained within inner housing 6 is light source 12. Inner housing 6 has curved edges 14 to facilitate its sliding in and out of outer housing 4, which also has curved outer edges 16.

Figure 2:
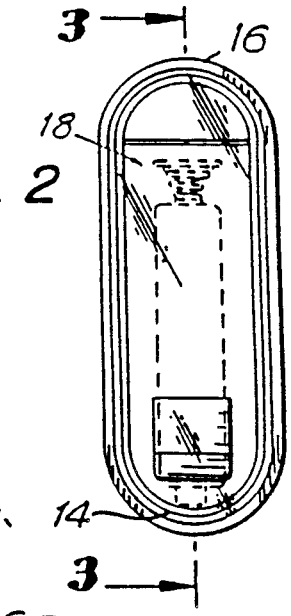
FIG. 2 is a end view of the signaling device of FIG. 1.

FIG. 2 is a top view of signaling device 2, with a power source housing 18 made of electrically insulated material contained within inner housing 6.

Figure 3:
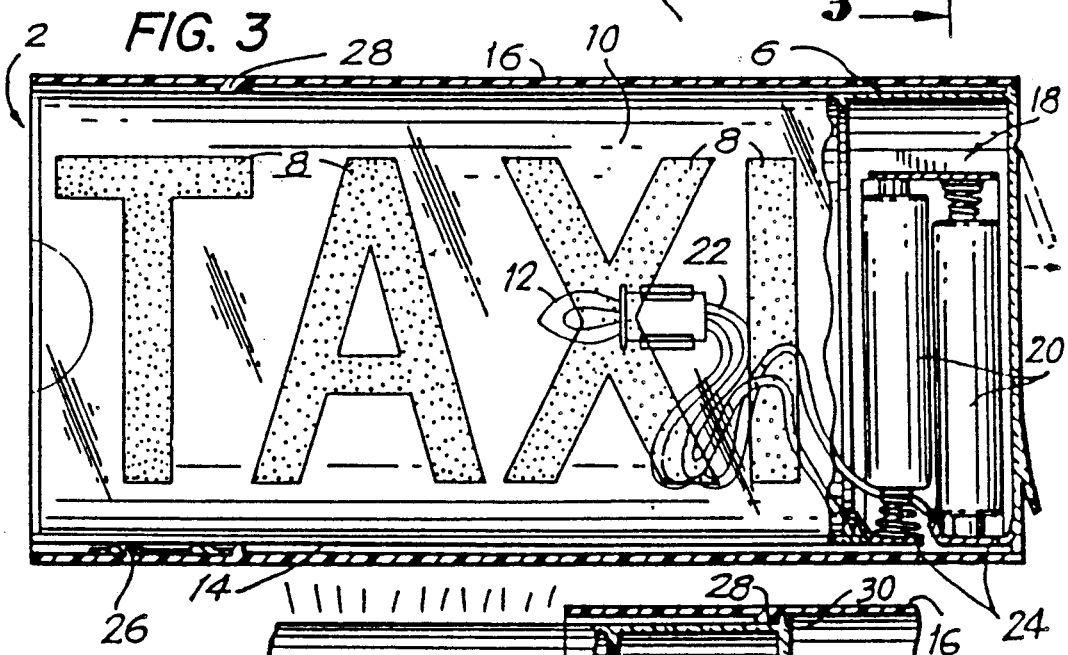
FIG. 3 is a cross-sectional planar view of the signaling device of FIG. 1, taken along line 3—3 of FIG. 2.

Signaling device 2 is in a closed position in FIG. 3, with outer housing 4 completely surrounding inner housing 6. Fluorescent symbols 8 are visible through transparent housing 8, thus enabling the signaling device to be used during the daylight hours even when in the closed, non-illuminating position. Electrical energy for causing light source 12 to illuminate is obtained from a plurality of batteries 20 contained in power source housing 18 and electrically connected to light source 12 by stiff wires 22. Stiff wires 22 enable light source 12 to remain in position in or about the middle of inner housing 6, evenly illuminating symbols 8. Contact points 24 in contact with the terminals of batteries 20, extend through power source housing 18 and through edge 14 of inner housing 6. Contact points 26 are affixed to curved edge 16 of outer housing 4. Ridge 28 is affixed to curved edge 16 of outer housing 4.

Figure 4:
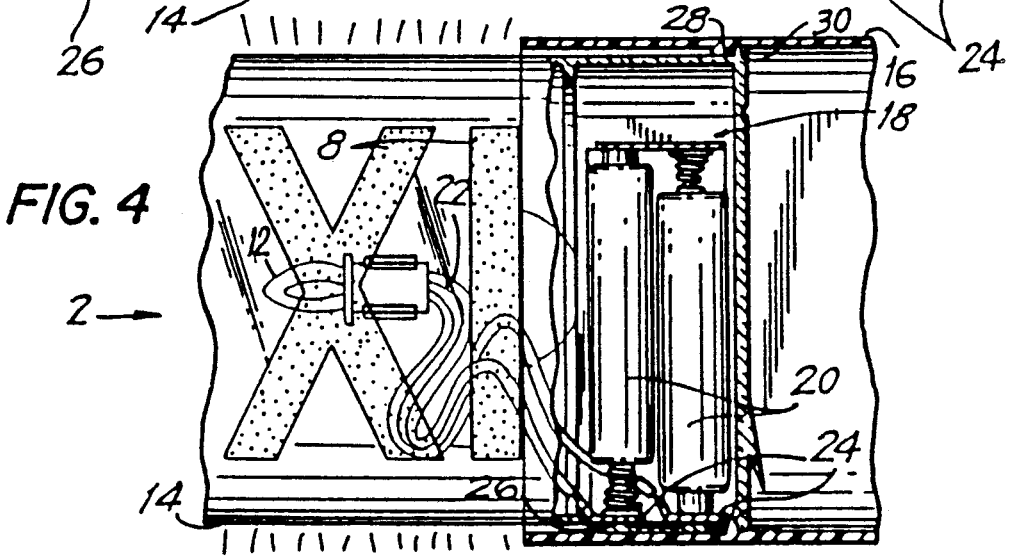
FIG. 4 is a partial cross sectional view of the signaling device of FIG. 1 with the outer housing in an exposed position with respect to the inner housing.

Signaling device 2 is an exposed position in FIG. 4 in which outer housing 4 does not surround symbols 8 affixed to outer face 10 of inner housing 6. Contact points 24 are met by contact points 26 and electrical energy flows to light source 12 from batteries 20. Symbols 8 are thereby illuminated, enabling the signaling device to be highly visible in the night-time hours. Ridge 28 meets protruding edge 30 of inner housing 6, and the inner housing is thereby prevented from sliding completely out of outer housing 4.

FIG. 5 is a representation of another embodiment of the invention, signaling device 32, in an exposed position and having circular outer housing 34 (preferably made of transparent plastic or other suitable material) and a circular, slidable inner housing 36. Symbols 38, forming the word "TAXI", are affixed to outer face 40 of inner housing 36. Light source 42 (preferably a fluorescent tube) is contained within inner housing 36. A plurality of channels 44 run horizontally along the entire length of outer face 40 of inner housing 36 on either side of symbols 38.

In FIG. 6, the position of light source 42 is shown relative to the placement of batteries 46, reflector surface 48, separating light source 42 from batteries 46, and back plate 50, shown in outline. Channels 44 are also seen in FIG. 6; channels 44 run horizontally along the entire length of inner housing 36 on either side of symbols 38 in FIG. 5. A plurality of protruding members 52 (see FIG. 6A) extend from the inner side of outer housing 34 to fit within channels 44. When outer housing 34 slides off inner housing 36 to expose symbols 38, protruding members 54 stop at the end of channel 44, preventing outer housing 34 from sliding off inner housing 36. Detent 54 is also provided to prevent the loss of outer housing 34; detent 54 contains spring 56 and ball 58, which is rotationally displaced so it does not ride in channel 44 but comes to rest in depression 60 of outer face 40 of inner housing 36.

Figure 7:
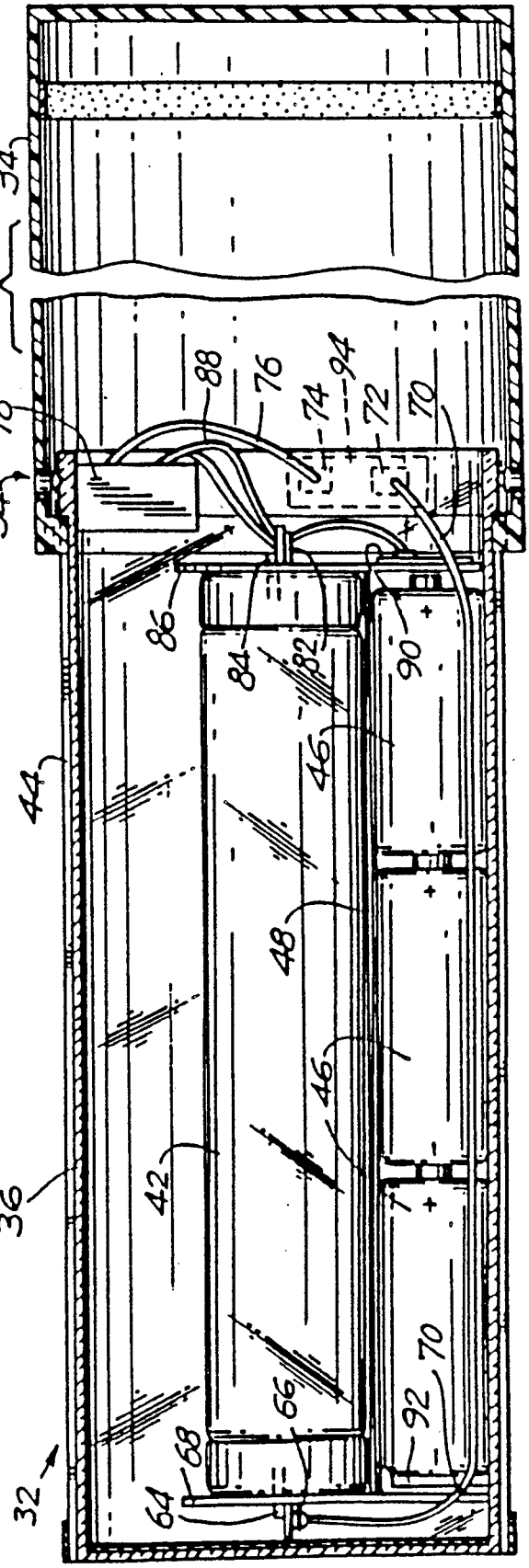
FIG. 7 is a cross-sectional planar view of the signaling device of FIG. 5 with the outer housing in an exposed position with respect to an inner housing.

The electrical connections among fluorescent tube 42, batteries 46, and electronics package 62 are shown in FIG. 7. Fluorescent tube 42 is separated from batteries 46 by reflector surface 48. Terminals 64 extend from tube 42 to rest upon metal plate 66, which is affixed to insulating plate 68. Insulating plate 68, which is attached to reflector surface 48, serves to prevent all but terminals 64 from being in contact with metal plate 66. Insulated ground wire 70, in electrical contact with metal plate 66, extends therefrom along batteries 46 and ends in electrical contact with contact point 72. In electrical contact with contact point 74 is insulated wire 76 which travels to make electrical contact with inverter 78. In electrical contact with inverter 78 is insulated wire 80, which is in electrical contact with metal plate 82, upon which terminals 84 from tube 42 are resting. Insulating plate 86 prevents all but terminals 84 from being in electrical contact with metal plate 82. Also in electrical contact with inverter 78 is insulated wire 88, which is in electrical contact with metal plate 90. Batteries 46 are in electrical contact with metal plate 90 and with metal plate 92.

Contact point 94 (shown in dotted lines) is affixed to the inner surface of outer housing 34. When outer housing 34 slides to reveal symbols 38, contact point 94 meets contact points 72 and 74 and the electrical circuit among batteries 46, tube 42 and electronics package 62 is completed and tube 42 is illuminated.

FIG. 8 is a representation of another embodiment of the invention, signaling device 100, in an exposed position, having an outer rotatable housing 102 (preferably made of transparent plastic or other suitable material) and an inner rotatable housing 104. Affixed upon outer surface 106 of inner housing 104 are symbols 108, which are viewed through aperture 110 of outer housing 102. Light source 112 (preferably a fluorescent tube) is contained within inner housing 104 along with an electronics package and power source as previously described. Circular housing 114 is fixedly affixed to inner housing 104 so that the axis of rotation of circular housing 114 is colinear with that of inner housing 104. Outer housing 102 and circular housing 114, abut one another, having an equivalent diameter and circumference. At the other end of signaling device 100, circular housing 116 is removably affixed to outer housing 102. The circumference and diameter of outer housing 102 are equivalent to the inner circumference and diameter of circular housing 116, such that outer housing 102 protrudes into circular housing 116 and rests in channel 118.

Upon outer housing 102 are the words "ON" at position 120 and "OFF" at position 122. An arrow symbol 124 is affixed to circular housing 114. Outer housing 102 rotates from the alignment of position 122 and arrow symbol 124 to the alignment of position 120 and arrow symbol 124. Stopping members 126 within circumferentially extending channel 118 (see FIG. 9) prevent outer housing 102 from over-rotation.

Contact points 128 are affixed to the outer surface of inner housing 104. Contact strip 130 is affixed to the inner surface of outer housing 104. When position 122 and arrow symbol 124 are aligned, contact points 128 do not meet contact strip 130. The electrical circuit is completed when outer housing 102 is rotated so that position 120 and arrow symbol 124 are aligned and contact points 128 and contact strip 130 meet, activating light source 112 such that symbols 108 are illuminated.

Figure 10:
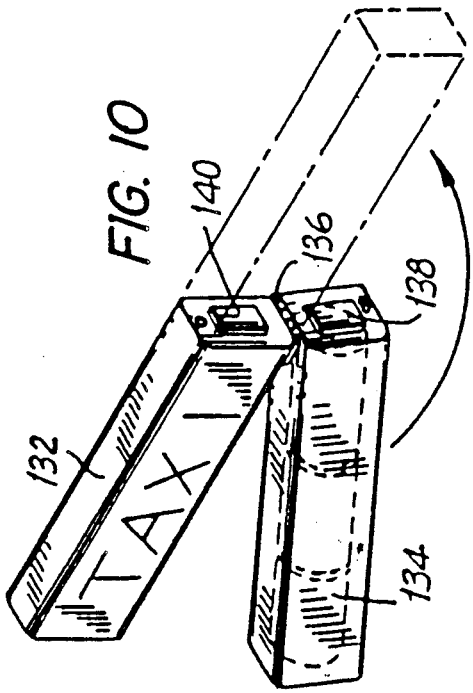
FIG. 10 is a perspective view of a hinged signaling device.

A representation of a hinged embodiment of the invention is shown in FIG. 10. First housing 132 is movably affixed to second housing 134 by hinge 136. A light source and power source (either incandescent or fluorescent) may be provided, as previously described. The light source is activated when first and second housings 132 and 134 swing along hinge 136 to an adjacent position and contact strip 138 meets contact strip 140 and an electrical circuit is completed.

Although the invention has been described in terms of specific embodiments and applications, persons skilled in the art in light of this teaching can generate additional embodiments without exceeding the scope or departing from the terms of the claimed invention. Accordingly, it is to be understood that the drawings and descriptions in this disclosure are proffered to facilitate comprehension of the invention and should not be construed to limit the scope thereof.

I claim:

1. A portable signaling device comprising;

(a) a rectangular outer housing having an outer surface and an inner surface;

(b) a rectangular inner housing having an outer surface and inner surface;

(c) at least one reflective symbol affixed to said outer surface of said inner housing;

(d) said outer housing being slidably mounted with respect to said inner housing, whereby said outer housing slides between a first position where said inner housing is surrounded by said outer housing and said symbol is not displayed and second position where said outer housing does not surround said inner housing and said symbol is displayed; said housings having curved edges to facilitate sliding between said first and second positions;

(e) a light source comprising a fluorescent tube attached to said inner housing;

(f) a power source comprising a plurality of batteries attached to said inner housing, having contact points extending therefrom and protruding through an edge of said inner housing, said power source being electrically connected to said light source;

(g) an electronics package attached to said inner housing which converts direct current to alternating current, said package providing an electrical connection between said fluorescent tube and said plurality of batteries;

(h) a second set of contact points affixed to said inner surface of said outer housing, said second set of contact points being in contact with said first set of contact points whereby said power source is activated and said symbol is illuminated when said outer housing is in the second position, and said first set of contact points being disconnected from said second set of contact points when said outer housing is in the first position;

(i) a ridge member protruding from an inner edge of said outer housing for placement within a aperture within said inner housing when said outer housing is in the second position, such that said inner housing is prevented from sliding out of said outer housing.

2. A portable signaling device comprising:

(a) a circular inner housing having an outer surface and an inner surface;

(b) at least one reflective symbol affixed to said outer surface of said inner housing;

(c) a circular outer housing having an aperture between an outer surface and an inner surface, said housing being rotatably mounted with respect to said inner housing whereby said outer housing rotates between a first position where said aperture is not aligned with said symbol and said symbol is not displayed and a second position where said aperture is aligned with said symbol and said symbol is displayed;

(d) a light source comprising a fluorescent tube attached to said inner housing;

(e) a power source comprising a plurality of batteries attached to said inner housing, having contact points protruding through an edge of said inner housing, said power source being electrically connected to said light source;

(f) an electronics package attached to said inner housing which converts direct current to alternating current, said package providing an electrical connection between said fluorescent tube and said plurality of batteries;

(g) a second set of contact points affixed to said inner surface of said outer housing, said second set of contact points being in contact with said first set of contact points whereby said power source is activated and said symbol is illuminated when said outer housing is in the second position, and said first set of contact points being disconnected from said second set of contact points when said outer housing is in the first position;

(h) a first circular housing fixedly connected to said inner housing at an end of said housing near said first set of contact points, said first circular housing having a diameter and circumference equivalent to that of said outer housing and abutting said outer housing;

(i) a second circular housing movably connected to an end of said outer housing at an opposite end to said first circular housing, said second circular housing having an inner diameter and circumference equivalent to that of the outer diameter of said outer housing, a channel in which said end of said outer housing rests, and stopping members in said channel to prevent free circular rotation by said outer housing.

3. A portable signaling device comprising:

(a) a rectangular outer housing having an outer surface and an inner surface;

(b) a rectangular inner housing having an outer surface and an inner surface;

(c) at least one reflective symbol affixed to said outer surface of said inner housing;

(d) said outer housing being slidably mounted with respect to said inner housing whereby said outer housing moves between a first position where said inner housing is surrounded by said outer housing and said symbol is not displayed and a second position where said outer housing does not surround said inner housing and said symbol is displayed, said housings having curved edges to facilitate sliding between said first and second positions;

(e) an incandescent light source attached to said inner housing;

(f) a power source comprising a plurality of batteries attached to said inner housing, having contact points extending therefrom and protruding through an edge of said inner housing, said power source being electrically connected to said light source;

(g) a second set of contact points affixed to said inner surface of said outer housing, said second set of contact points being in contact with said first set of contact points whereby said power source is activated and said symbol is illuminated when said outer housing is in the second position, and said first set of contact points being disconnected from said second set of contact points when said outer housing is in the first position;

(h) a ridge member protruding from an inner edge of said outer housing for placement within an aperture within said inner housing when said outer housing is in the second position, such that said inner housing is prevented from sliding out of said outer housing.

4. A portable signaling device comprising:

(a) a circular outer housing having an outer surface and an inner surface;

(b) a circular inner housing having an outer surface and an inner surface;

(c) at least one reflective symbol affixed to said outer surface of said inner housing;

(d) said outer housing being slidably mounted with respect to said inner housing whereby said outer housing moves between a first position where said inner housing is surrounded by said outer housing and said symbol is not displayed and a second position where said outer housing does not surround said inner housing and said symbol is displayed;

(e) a light source comprising a fluorescent tube attached to said inner housing;

(f) a power source comprising a plurality of batteries attached to said inner housing, having contact points extending therefrom and protruding through said inner housing, said power source being electrically connected to said light source;

(g) an electronics package attached to said inner housing which converts direct current to alternating current, said package providing an electrical connection between said fluorescent tube and said plurality of batteries;

(h) a second set of contact points affixed to said inner surface of said outer housing, said second set of contact points being in contact with said first set of contact points whereby said power source is activated and said symbol is illuminated when said outer housing is in the second position, and said first set of contact points being disconnected from said second set of contact points when said outer housing is in the first position;

(i) protruding members affixed to an inner curved face of said outer housing for placement within channels running horizontally from one end to an opposite end of an outer curved surface of said inner housing, such that said outer housing slides easily over said inner housing;

(j) stopping members affixed within said channels at one end thereto, such that said inner housing is prevented from sliding out of said outer housing by said protruding members meeting said stopping members.

5. A portable signaling device comprising:

(a) a circular outer housing having an outer surface and an inner surface;

(b) a circular inner housing having an outer surface and an inner surface;

(c) at least one reflective symbol affixed to said outer surface of said inner surface;

(d) said outer housing being slidably mounted with respect to said inner housing whereby said outer housing moves between a first position where said inner housing is surrounded by said outer housing and said symbol is not displayed and a second position where said outer housing does not surround said inner housing and said symbol is displayed;

(e) an incandescent light source attached to said inner housing;

(f) a power source comprising a plurality of batteries attached to said inner housing, having contact points extending therefrom and protruding through said inner housing, said power source being electrically connected to said light source;

(g) a second set of contact points affixed to said inner surface of said outer housing, said second set of contact points being in contact with said first set of contact points whereby said power source is activated and said symbol is illuminated when said outer housing is in the second position, and said first set of contact points being disconnected from said second set of contact points when said outer housing is in the first position;

(h) protruding members affixed to said inner curved face of said outer housing for placement within channels running horizontally from one end to an opposite end of said outer curved face of said inner housing, such that said outer housing slides easily over said inner housing;

(i) stopping members affixed within said channels at one end thereto, such that said inner housing is prevented from sliding out of said outer housing by said protruding members meeting said stopping members.

6. A portable signaling device comprising:

(a) a circular inner housing having an outer surface and an inner surface;

(b) at least one reflective symbol affixed to said outer surface of said inner surface;

(c) a circular outer housing having an aperture between an outer surface and an inner surface, said housing being rotatably mounted with respect to said inner housing whereby said outer housing rotates between a first position where said aperture is not aligned with said symbol and said symbol is not displayed and a second position where said aperture is aligned with said symbol and said symbol is displayed;

(d) an incandescent light source attached to said inner housing;

(e) a power source comprising a plurality of batteries attached to said inner housing, having contact points protruding through an edge of said inner housing, said power source being electrically connected to said light source;

(f) a second set of contact points affixed to said inner surface of said outer housing, said second set of contact points being in contact with said first set of contact points whereby said power source is activated and said symbol is illuminated when said outer housing is in the second position, and said first set of contact points being disconnected from said second set of contact points when said outer housing is in the first position;

(g) a first circular housing fixedly connected to said inner housing at an end of said housing near said first set of contact points, said first circular housing having a diameter and circumference equivalent to that of said outer housing and abutting said outer housing;

(h) a second circular housing movably connected to an end of said outer housing at an opposite end to said first circular housing, said second circular housing having an inner diameter and circumference equivalent to that of the outer diameter of said outer housing, a channel in which said end of said outer housing rests, and stopping members in said channel to prevent free circular rotation by said outer housing.

* * * * *